United States Patent [19]

Disdier

[11] 4,193,337

[45] Mar. 18, 1980

[54] PNEUMATIC ROTARY ACTUATOR

[76] Inventor: Carlos A. Disdier, 7311 E. 59th Pl., Tulsa, Okla. 74145

[21] Appl. No.: 869,713

[22] Filed: Jan. 16, 1978

[51] Int. Cl.[2] ..... F01B 3/04

[52] U.S. Cl. ..... 92/31; 74/99 R

[58] Field of Search ..... 92/31; 251/58; 74/99 R, 74/56

[56] References Cited

U.S. PATENT DOCUMENTS

| | | | |
|---|---|---|---|
| 1,052,763 | 2/1913 | Stone et al. | 92/31 |
| 2,315,775 | 4/1943 | D'Arcey | 92/31 |
| 2,998,805 | 9/1961 | Usab | 251/58 X |
| 3,046,802 | 7/1962 | Cupedo | 92/31 X |
| 3,078,065 | 2/1963 | Vickery | 251/58 |
| 3,207,468 | 9/1965 | Lauducci et al. | 92/31 X |
| 3,319,925 | 5/1967 | Kojima et al. | 92/31 X |
| 3,417,960 | 12/1968 | Stehlin | 251/58 X |

*Primary Examiner*—Irwin C. Cohen
*Attorney, Agent, or Firm*—Head & Johnson

[57] ABSTRACT

An apparatus for providing rotational torque in response to fluid pressure including a housing having a diaphragm therein with means of providing differential fluid pressure across the diaphragm, a cylindrical plate acted upon by the diaphragm, a tubular fixed member supported coaxially within and attached to the housing, the fixed member having a longitudinal opening therethrough, a rotatable shaft partially received within the fixed member and partially extending externally of the housing, a longitudinal actuator member slidably and non-rotatably received within the fixed member, the actuator member having an axial opening therein telescopically receiving the shaft member and having an inclined slot defining a partial spiral about the longitudinal axis, a pin extending perpendicularly from the shaft and slidably received in the slot in the actuator member, the actuator member being affixed to the circular plate so that as fluid pressure is applied to the diaphragm the actuator member slides in the fixed member and imparts rotation to the pin and thereby to the actuator member to rotate the shaft. The device is particularly adaptable as an actuator for a rotatable valve, the actuator being affixed to the shaft of the valve so that the valve can be opened and closed by the application of pressure differential across the diaphragm.

1 Claim, 9 Drawing Figures

PNEUMATIC ROTARY ACTUATOR

BACKGROUND AND OBJECTS OF THE INVENTION

Many devices utilized in industry require rotational torque for their operation. As an example, most valves have a stem extending from the body and are opened or closed by rotation of the stem. Many types of valves, such as butterfly valves and ball valves are moved from the fully opened to the closed position, or vice versa, by rotation of the valve stem through approximately 90°.

Others have provided devices for producing rotational torque to actuate valves; however, most hydraulic or pneumatic valve actuators require a large amount of space. Most mechanisms for rotating the stem of a valve through 90° of rotation employ a crank arm affixed to the valve stem with a mechanism to reciprocate the crank arm.

The present invention is directed toward a device for converting linear to rotary motion and more particularly to a device which utilizes hydraulic or pneumatic pressure for rotation of a valve stem. A particular object of this invention is to provide an actuator responsive to hydraulic or pneumatic pressure, to rotate a valve stem in an arrangement wherein all of the components necessary to effect the rotation of the valve stem are arranged symmetrically about the axis of the valve stem to thereby conserve space and achieve the rotation of the valve stem with a minimum number of operating components.

It is therefore a general object of this invention to provide an apparatus for converting linear to rotary motion.

More particularly, an object of this invention is to provide an apparatus responsive to hydraulic or pneumatic pressure to move a rotatable element, such as a valve stem, through approximately 90° of rotation arranged in a manner such that all of the operating components are symmetrical about the valve stem axis.

These general objects as well as other and more specific objects of the invention will be fulfilled in the following description and claims, taken in conjunction with the attached drawings.

SUMMARY OF THE INVENTION

An apparatus is provided for producing rotational torque response to fluid pressure, such as for rotating a valve stem to move the valve from open to closed position, or vice versa. The apparatus includes a diaphragm mounted in the upper part of a housing with means to provide differential fluid pressure across the diaphgram. A cylindrical plate is acted on by the diaphragm . A stem extends from the plate. A fixed member having a longitudinal opening therethrough is supported in the bottom of the housing and receives a rotatable shaft member partially received within the lower end of the fixed member and partially extending externally of the housing for attachment, such as to the stem of a valve. A longitudinal actuator member is slidably and non-rotatably received in the fixed member, the actuator member having an axial opening therein telescopically receiving the upper end of the shaft member. The actuator member has an inclined slot defining a partial spiral about the longitudinal axis. A pin member extends perpendicularly from the shaft and is slidably received in the slot in the actuator member so that as the actuator member is longitudinally displaced within the fixed member, the pin is moved by the spiral slot to rotate the shaft.

DETAILED DESCRIPTION OF THE PREFERRED EMBODIMENT

Figure 1:
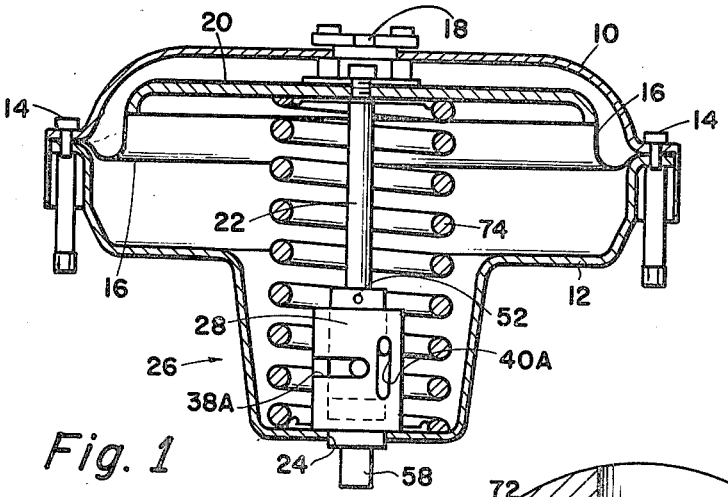
FIG. 1 is a cross-sectional view of an apparatus employing this invention wherein te device is contained within a housing having a diaphragm therein.

Referring to the drawings and first to FIG. 1, an external view of a mechanism for providing rotary motion as may be employed to rotate a valve stem is illustrated in cross-section. The device includes an inverted dish-shaped housing upward portion 10 and a dish-shaped housing lower portion 12. The housing portions 10 and 12 are joined to each other by bolts 14 and the joinder captures the external periphery of a diaphragm 16. Housing upper portion 10 has an opening 18 by which a line may be connected to apply fluid pressure to the top surface of diaphragm 16.

Affixed within the housing and in engagement with the diaphragm is a plate 20 which is moved in response to pressure applied against diaphgram 16. Affixed centrally of plate 20 is a rod 22.

Figure 3:
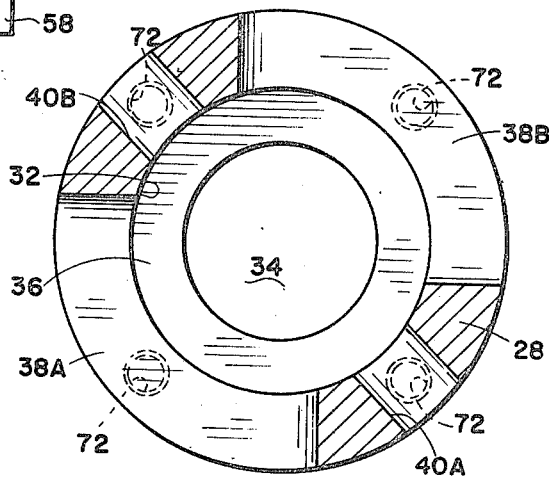
FIG. 3 is a cross-sectional view of the fixed member taken along the line 3—3 of FIG. 2.
Figure 2:
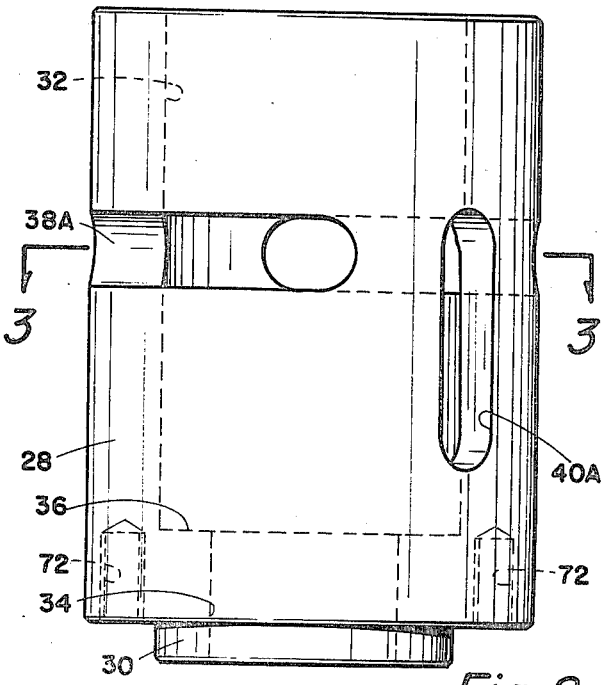
FIG. 2 is an enlarged elevational view of a fixed member as employed in the mechanism.
Figure 7:
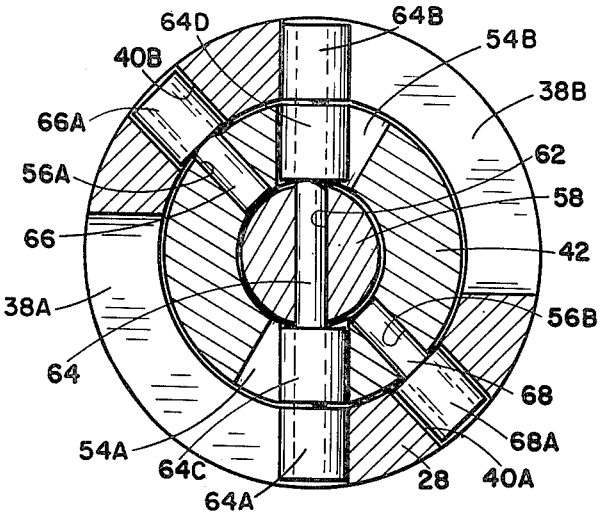
FIG. 7 is a cross-sectional view taken along the line 7—7 of FIG. 6.
Figure 9:
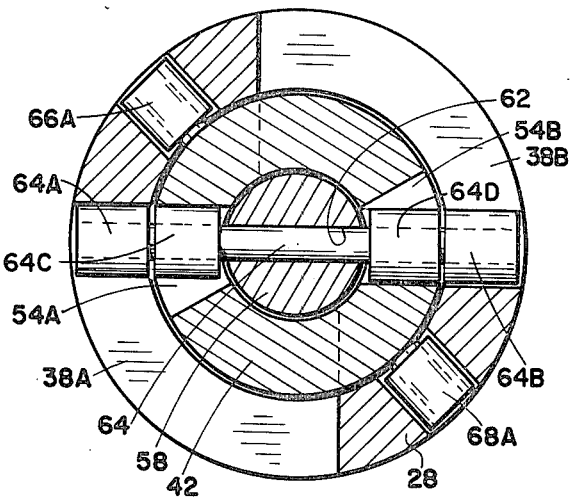
FIG. 9 is a cross-sectional view taken along the line 9—9 of FIG. 8.

The lower housing portion 12 has an axial opening 24 in the lower end thereof. Positioned internally of the housing is the mechanism for converting linear displacement of rod 22 to rotational force, the mechanism being generally indicated by the numeral 26. The mechanism 26 includes as a first base element, a cylindrical fixed member 28 which has an integral reduced diameter lower shoulder portion 30 received in the lower housing opening 24. The configuration of the fixed member 28 is best shown in FIGS. 2 and 3. Member 28 is tubular with an upper internal axial opening 32 and a lower coaxial reduced diameter opening 34. The meeting of openings 32 and 34 provide internal shoulder 36. Fixed member 28 also includes opposed semi-circular slots 38A and 38B, the slots being in a plane perpendicular the longitudinal axis of the member. Slots 38A and 38B each encompass slightly more than 90° of the tubular member. In addition, fixed member 28 includes opposed longitudinal slots 40A and 40B. The longitudinal slots are displaced from the semi-circular slots 38A and 38B and are in a plane of the longitudinal axis of member 28.

Figure 5:
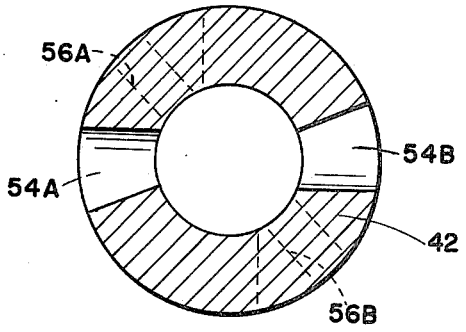
FIG. 5 is a cross-sectional view of the actuator member taken along the line 5—5 of FIG. 4.
Figure 4:
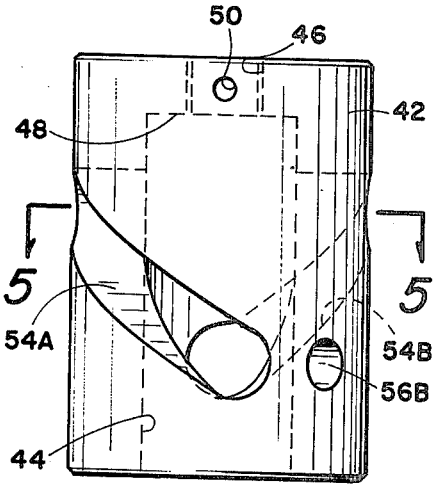
FIG. 4 is an external elevational view of the actuator member employed in the apparatus.
Figure 6:
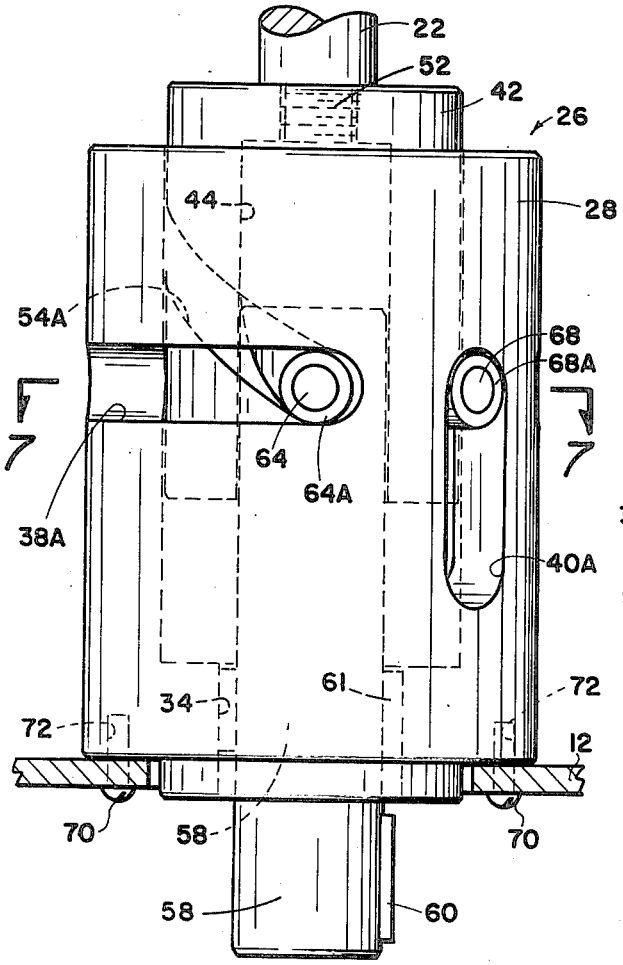
FIG. 6 is an enlarged elevational view of the mechanisn assembled and showing the actuator member in the upper position.
Figure 8:
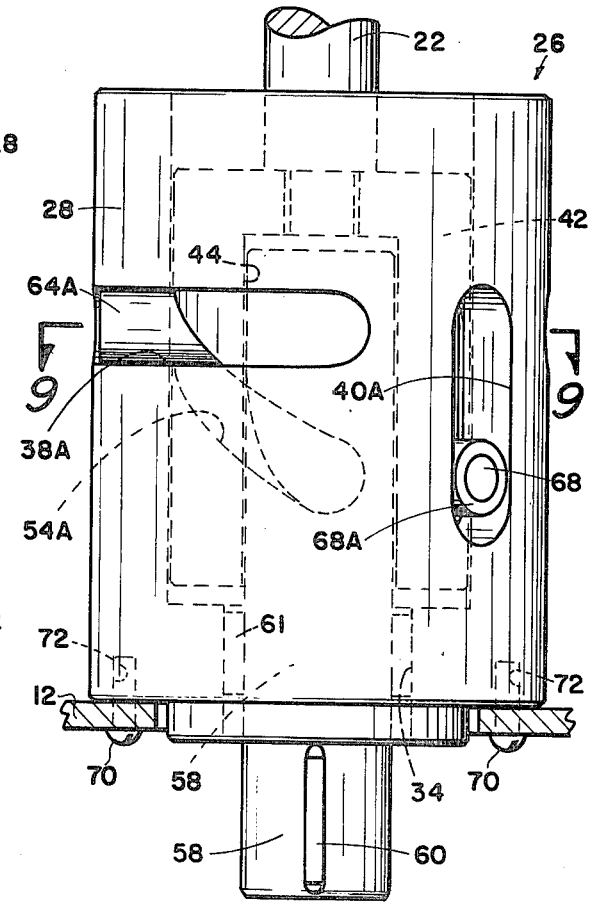
FIG. 8 is an elevational view of the operating mechanism as shown in FIG. 6 but showing the actuator in the lower position and the shaft rotated 90° relative to the position shown in FIG. 6.

Slidably positioned in opening 32 in the fixed member is the second basic element, an actuator member 42 illustrated in FIGS. 4 and 5. The actuator member is tubular with a large diameter lower axial opening 44 and a reduced diameter upper opening 46, providing an internal shoulder 48 at the juncture of openings 46 and 44. A pin opening 50 is provided which receives a pin 52 as shown in FIGS. 6 and 8. The threaded lower end 52 of rod 22 is received in upper opening 46.

Formed in the actuator member 42 between the external cylindrical surface and opening 44 are opposed spiral slots 54A and 54B. Each of these spiral slots 54A and 54B extends for slightly more than 90° around the periphery of the actuator member.

Positioned in the lower portion of actuator member 42 is a pair of opposed openings 56A and 56B. These openings are aligned about an axis which intersects the longitudinal axis of the member 42 perpendicularly.

The third basic element of the mechanism 26 which converts the longitudinal displacement of rod 22 to rotary motion is a rotatable shaft member 58 as shown in FIGS. 6, 7, 8 and 9. The lower end of shaft member 58 extends beyond the lower end of fixed member 28 and beyond the lower end of housing lower portion 12 to serve as a means for delivering rotational torque. In practical application, the extending lower end of shaft 58, which may include a key 60 as shown in FIGS. 6 and 8, is adapted for attachment to a valve stem such as by means of a coupling (not shown) or shaft 58 may be a part of the valve to which the actuator is attached. The shaft 58 is rotatably received in opening 34 of the fixed member 28 and also rotatably and slidably received in opening 44 of actuator member 42. A bushing 61 is positioned between shaft 58 and opening 34. An opening 62 through the shaft 58 (see FIGS. 7 and 9) receives a pin 64. The outer ends of pin 64 receive sleeve bearings 64A, 64B, 64C and 64D. Sleeve bearings 64A and 64B are received in semi-circular slots 38A and 38B and bearings 64C and 64D are received in the spiral slots 54A and 54B respectively in the actuator member 42. The function of pin 64 is to transmit rotational torque to shaft 58 when the actuator member 42 is longitudinally displaced within the fixed member 28. The action of the pin outer ends in the fixed member slots 38A and 38B is to permit the rotation of shaft 58, but at the same time, resist longitudinal displacement of the shaft.

Received in opening 56A in actuator member 42 is a pin 66 having a sleeve bearing 66A. In like manner, a pin 68 is received in opening 56B, the outer end receiving a sleeve bearing 68A. Sleeve bearing 66A is received in slot 40B of fixed member 28 and in like manner, slot 40A receives sleeve bearing 68A. Pins 66 and 68 serve to guide the actuator member 42 within the fixed member 28, permitting the longitudinal displacement thereof but resisting rotation of the actuator member relative to the fixed member.

As shown in FIGS. 6 and 8, the fixed member is secured to the lower housing 12 by means of bolts 70 extending through the housing and received in threaded openings 72.

Referring back to FIG. 1, a coil spring 74 is compressibly positioned between the diaphragm plate 20 and the lower end of housing 12. Spring 74 urges the diaphragm plate 20 upwardly. When fluid pressure, whether gas or liquid, but in the illustrated embodiment preferably gas, supplied through opening 18 to the upper surface of diaphragm 16 is below a preselected level, spring 74 overcomes the pressure and moves the diaphragm and rod 22 upwardly. By application of increased pressure, the diaphragm 16 and plate 20 with rod 22 attached is forced downwardly against the compression of spring 74. Thus the spring 74 is used to move rod 22 in one direction in the absence of pressure above a preselected level and the application of pressure to the top of the diaphragm moves the rod 22 in the opposite direction when the pressure is above the preselected level. It can be seen that spring 74 may be eliminated and that means may be provided to apply pressure to the lower housing 12 and to the underneath side of the diaghragm so that the position of the diaphragm would respond entirely to pressure differential thereacross. The use of spring 74 is to provide the mechanism with a normal position and an actuated position and to return the mechanism to the normal position in the absence of pressure applied through opening 18 above a preselected level.

OPERATION

Referring to FIG. 6, the mechanism 26 is shown wherein rod 22 is in the upward position, indicating insufficient pressure against the diaphragm necessary to overcome the compression of spring 74. The actuator member 42 is affixed to the lower end of rod 22 and is thus in the upward position. Pin 64 is at the bottom of actuator member spiral slots 54A and 54B. Pins 66 and 68 are at the upper ends of longitudinal slots 40A and 40B of the stationary member. With the application of fluid pressure to the upper surface of diaphragm 20 through opening 18, the diaphragm moves downwardly against the compression of spring 74, moving rod 22 and actuator member 42 downwardly. This downward motion within fixed member 28 causes pin 64 to rotate in slots 54A and 54B. At the same time, pins 66 and 68 slide downwardly in longitudinal slots 40A and 40B. The reaction of pin 64 to spiral slots 54A and 54B causes the pin and thereby shaft 58 to rotate to the position as shown in FIG. 8. When the slots encompass approximately 90° of the periphery of actuator member 42, the shaft 58 rotates approximately 90° as illustrated by comparison of FIGS. 6 and 8.

When fluid pressure is removed from opening 18, spring 74 overcomes the pressure and moves the diaphragm plate 20 and rod 22 upwardly, reversing the reaction of pin 64 with slots 54A and 54B, rotating shaft 58 in the opposite direction back to the position as shown in FIG. 6. In this manner, by the application of fluid pressure to the mechanism, the shaft 58 is caused to rotate in one direction and when pressure is removed, it is caused to rotate in the opposite direction. When shaft 58 is connected to a valve stem, the valve is thereby caused to rotate in response to the application or removal of pressure to the mechanism.

It should be noted that all of the mechanism required to cause rotation of stem 58 is symmetrical about the stem, and all of the mechanism is confined within the housing formed of portions 10 and 12. There are no linkages exposed to cause injury and the whole device is compact and susceptible of economical construction.

While the invention has been described with a certain degree of particularity it is understood that the invention is not limited to the embodiment set forth herein for purposes of exemplification,. Instead, the invention is to be limited only by the scope of the attached claim or claims, including the full range of equivalency to which each element thereof is entitled.

What is claimed is:

1. Apparatus for providing rotational torque in response to fluid pressure comprising:

a cup-shaped housing lower portion having an axial opening therein;

a housing upper portion affixed to and closing said housing lower portion;

a flexible diaphragm having the periphery thereof secured to the interior surface of the closed housing;

a circular plate within the closed housing, the plate being engaged by said diaphragm and displaced by the application of unequal fluid pressure to opposed sides of the diaphragm;

a tubular cylindrical fixed member supported coaxially within and attached to said housing lower portion, the fixed member having its cylindrical surface radially spaced from said housing lower portion and having a longitudinal opening therethrough coaxial with said housing lower portion opening; the fixed member having a longitudinal slot there through in a plane of the axis of said longitudinal opening;

a rotatable shaft member, the upper portion being received in said fixed member and the lower portion extending out the fixed member and through said housing lower portion opening;

a longitudinal actuator member received in said fixed member, a pin extending from said actuator member received in said longitudinal slot in said fixed member, thereby serving to permit slidable but non-rotatable movement of said actuator member relative to said fixed member; the actuator member having an axial opening therein telescopically receiving said shaft member upper portion, the actuator member having an inclined slot therein defining a partial spiral about the longitudinal axis;

a rod axially connecting said plate and said actuator member;

a pin member extending perpendicularly from said shaft member and slidably received in said slot in said actuator member whereby unequal fluid pressure across said diaphragm displaces said plate, said rod and said actuator member relative to said fixed member and said shaft member whereby the interaction of said pin member in said slot causes said shaft member to rotate;

said fixed member has a semi-circular slot therein in a plane perpendicular said opening longitudinal axis and wherein said pin member extending perpendicularly of said shaft and slidably received in said slot in said actuator member is also received in the fixed member semi-circular slot; and a spring compressibly positioned around said rod and cylindrical fixed member and between said plate and said housing lower portion normally urging said plate and thereby said rod and actuator member in the upward direction.

* * * * *